US005174388A

United States Patent [19]

Williams et al.

[11] Patent Number: 5,174,388

[45] Date of Patent: Dec. 29, 1992

[54] DRIVER TOOL AND METHOD

[76] Inventors: Tunney E. Williams, 126 Tanglewood Dr., Lynchburg, Va. 24502; Grady L. Parker, 205 Timberridge Dr., Forest, Va. 24551

[21] Appl. No.: 757,206

[22] Filed: Sep. 10, 1991

[51] Int. Cl.[5] ..... E02D 7/06

[52] U.S. Cl. ..... 173/1; 173/31; 173/90; 173/128; 405/232

[58] Field of Search ..... 173/1, 31, 32, 90, 128; 405/232

[56] References Cited

U.S. PATENT DOCUMENTS

| | | | |
|---|---|---|---|
| 1,655,265 | 1/1928 | Guiducci | 173/31 |
| 3,499,497 | 3/1970 | Moore | 405/232 X |
| 4,099,579 | 7/1978 | Stormon | 173/31 X |
| 4,448,264 | 5/1984 | Peyton | 173/129 X |
| 4,494,612 | 1/1985 | Bell | 173/1 |
| 4,665,994 | 5/1987 | Snider | 405/232 X |
| 4,989,677 | 2/1991 | Lam | 405/232 X |

*Primary Examiner*—Douglas D. Watts
*Assistant Examiner*—Rinaldi Rada
*Attorney, Agent, or Firm*—Nixon & Vanderhye

[57] ABSTRACT

The present invention relates to a tool and method of using the same for pushing or pressing rods into the earth. A moveable pusher body is mounted on an elongated, slotted mast, and is provided with several pivotal pusher plates which are implemented one at a time so as to press a rod into the ground, in incremental fashion, under the force of a downward stroke from a prime mover. A coupling tool may also be provided so that several lengths of rods can be inserted into the ground.

19 Claims, 3 Drawing Sheets

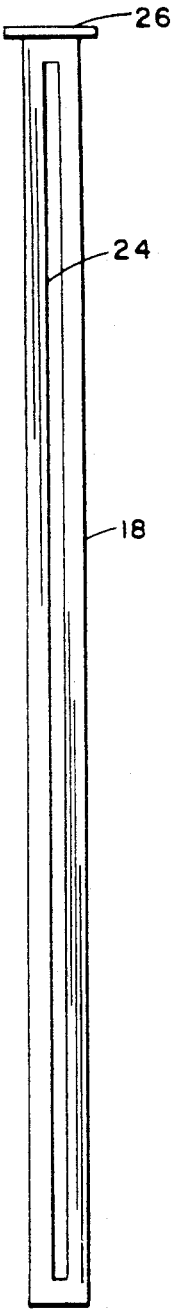
FIG. 3
FIG. 4
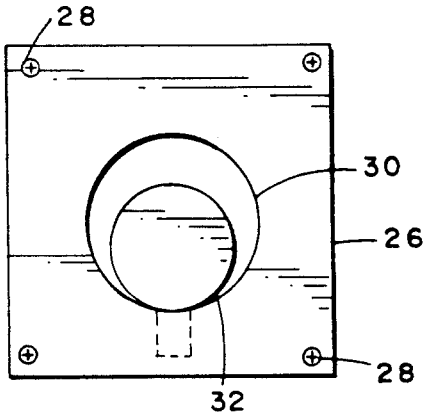
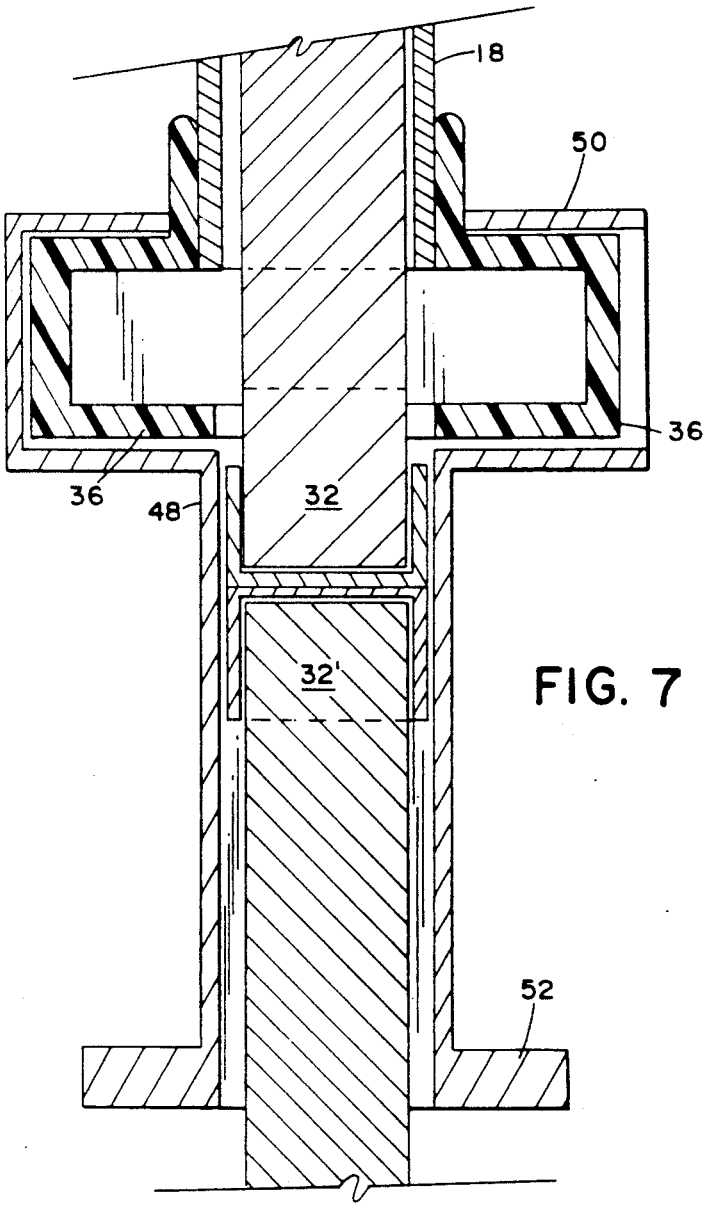
FIG. 7

DRIVER TOOL AND METHOD

FIELD OF THE INVENTION

This invention relates generally to a driving tool which is used to insert ground rods into the earth.

BACKGROUND AND SUMMARY OF THE INVENTION

Ground rods are used by utility companies to earth ground equipment associated with power distribution systems, e.g. high tension towers and light poles, so as to prevent damage caused by lightning, electrical surges, stray voltages and the like. Typically, ground rods have been constructed of copper or other core material having a copper sheath.

Presently, it is customary to hammer or drive the rod into the earth by some sort of impacting device. If a copper rod is utilized as the ground rod, the repeated impacting may cause the end of the rod to flatten, due to its soft malleable nature, thereby limiting the depth to which the ground rod can be driven into the earth. If the end of the rod has been flattened, additional rods may not be able to be connected to the inserted rod (it is often necessary to drive several lengths of rods into the earth so as to obtain the desired or necessary grounding depth).

Another problem associated with conventional driving practices is that the friction caused by impacting may cause the rod to bend and/or deform, when the rod is being driven through more stubborn strata. This in turn makes it even more difficult to drive the rod into the ground. Furthermore, glancing blows to the rod may cause the rod to whip violently from side to side, creating the potential for injury to unwary bystanders or damage to nearby equipment.

Another method of inserting ground rods into the earth is by drilling or boring. This technique, however, typically requires the utility company to carry a drilling rig or the like to the site, which is a costly and time consuming process.

One example of a known ground rod pusher is illustrated in U.S. Pat. No. 2,327,616, issued Aug. 24, 1943 to Abramson et al. Abramson et al disclose a portable rod inserting device comprising a motor, bore assembly (collet and chuck) and supporting equipment. The motor imparts rotary motion to the bore assembly, which holds the rod, while manual downward pressure is exerted on a pair of handles which extend outwardly from the bore assembly. The bore assembly is fastened to the rod and pushed is downward until the bore assembly contacts the base of the apparatus. The bore assembly is then unfastened, moved back to the starting position and refastened to the rod and the procedure repeated. One end of the rod is also provided with a drilling head so as to precipitate the breaking of the surface of the soil. Furthermore, the apparatus can be used to insert several rods, which have been connected together, into the ground.

Accordingly, there is a current need to drive ground rods into the earth without the aforementioned problems or surplusage of equipment. The ability to reliably and easily drive a ground rod into the earth would result in substantial savings in time and materials while simultaneously allowing utility companies to obtain greater grounding connections by inserting several lengths of rods to thereby reach greater depths. To achieve this result, a device is required which is capable of inserting the ground rod by pushing (or pressing) rather than by drilling or repeatedly impacting.

The present invention provides a novel and improved device for pressing rods into the earth. The exemplary embodiment of this invention uses a plurality of pivotable pusher plates axially mounted on the exterior of a hollow pusher body. An elongated, slotted, hollow mast is provided, upon which the pusher body is slidably mounted and includes a tube which is sized and configured to stabilize the rod within the tool. The pusher plates are pivoted inwardly through slots so as to rest upon the top of a rod which has been previously inserted within the mast. A downward stroke from a prime mover, or other mechanical source, applies a downwardly directed pressing force and through the pusher body and pusher plates presses the rod into the earth.

The exemplary pushing tool may also be provided with a coupling tool. One end of the coupling tool is connected to the bottom of the tool and the other end is provided with a foot plate to support the tool while in use. The coupling tool serves to automatically align the pusher body and mast containing an additional rod, over a previously inserted rod so that one or more rods may be pushed or pressed into the earth.

The exemplary method of using the pushing tool comprises loading a rod into an elongated mast on which is mounted a moveable pusher body having plural pusher plates. A first pusher plate is pivoted inwardly so as to rest upon the top of the rod so that a downward stroke from a prime mover applies a pressing force to the pusher body, and through the first pusher plate, the rod is pushed into the earth a first distance. Once the first downstroke is complete, the pusher body is retracted so that the top of the rod is adjacent to a second pusher plate. Prior to the actuation of the prime mover for a second stroke, the second pusher plate is pivoted inwardly so as to rest upon the top of the rod. A second down stroke applies a pressing force to the pusher body and through the second pusher plate, the rod is driven into the earth a second additional distance. The pusher body is once again retracted so that the top of the rod is adjacent to the third pusher plate. The third pusher plate is now pivoted inwardly and a third down stroke is applied to the pusher body, and through the third pusher plate, the rod is fully driven into the earth.

It is appreciated that the axial distance between the pusher plates is substantially equal to the maximum distance traveled during a single downward stroke of the prime mover and that after each downward stroke the pusher body is retracted a substantially equal and opposite distance so as to be ready for the next actuation of the prime mover.

Other objects and advantages of the invention will become apparent from the detailed description which follows.

BRIEF DESCRIPTION OF THE DRAWINGS

FIG. 3 is a front schematic view illustrating the slotted mast and top plate;

FIG. 4 is a top elevational view illustrating the aperture of the top plate of the mast;

FIG. 7 is a cross sectional view illustrating a coupling tool in connection with a pusher tool.

DETAILED DESCRIPTION OF THE DRAWINGS

Figure 1:
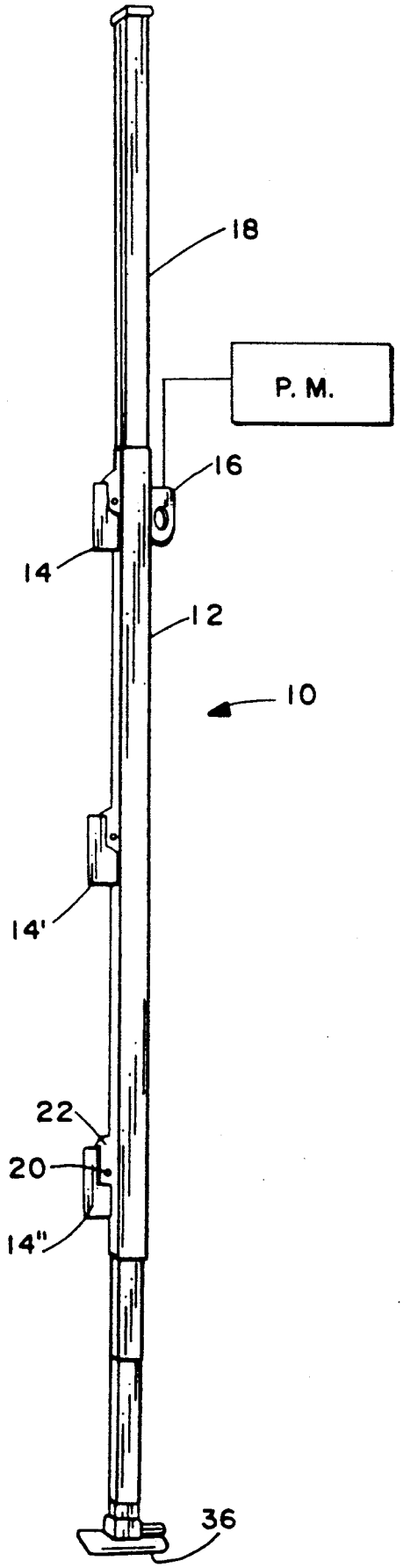
FIG. 1 is a full perspective view illustrating a pushing tool constructed in accordance with the present invention.

A ground rod insertion device, generally designated 10 and illustrated in FIG. 1, includes a hollow pusher body 12, first, second and third pusher plates designated 14, 14' and 14", respectively, positioned at axially spaced locations along pusher body 12, and mounted for pivotal movement. A pusher block 16 is provided near the top of pusher body 12 so as to provide a connection surface so that pusher tool 10 may be attached to a prime mover p.m.. Pusher body 12 is slidably mounted on an elongated, hollow mast 18.

Figure 2:
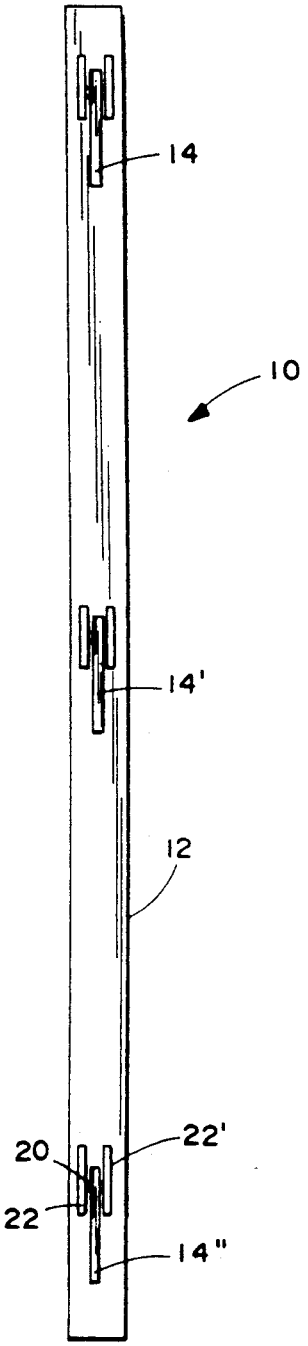
FIG. 2 is a front schematic view illustrating the pusher body and pusher plates.

Referring now to FIG. 2, pusher body 12 is illustrated with three pusher plates 14, 14' and 14", mounted for pivotal movement about a horizontal pin 20 which is supported at each end by a pair of mounting bars 22 and 22', respectively. A slot 34 (see FIG. 5) is provided underneath each of the pusher plates 14, 14' and 14" so as to allow each pusher plate to be pivoted inwardly of pusher body 12. Corresponding slots 24 and 24' are provided in mast 18 and tube 19, respectively, so that the pusher plates come to rest upon the top of ground rod 32 as shown in FIG. 5.

FIG. 3 illustrates the mast 18 as having an axially extending slot 24 which extends nearly the entire length of a single side of mast 18. Mast 18 is further provided with a top plate 26 (FIG. 4) which is secured to mast 18 by fasteners 28, or by other suitable means, such as weldments. Top plate 26 is illustrated as having a slightly larger width than that of mast 18 so as to provide a stop for pusher body 12. Top plate 26 is further provided with an aperture 30, into which a ground rod 32 may be inserted. In a preferred embodiment, aperture 30 may be slightly offset from center to bring ground rod 32 into a closer proximity with pusher plates 14, 14' and 14".

Figure 5:
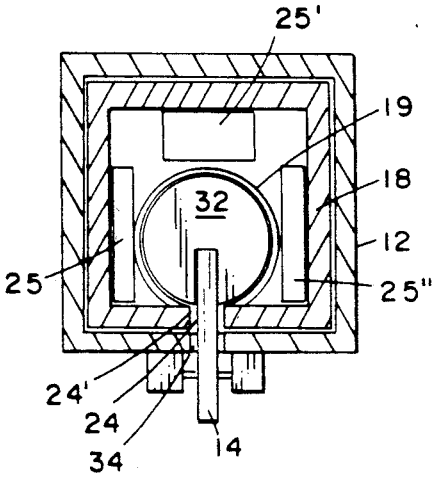
FIG. 5 is a cross sectional view illustrating the pusher body, mast, tube and pusher plate contacting a ground rod.

Turning now to FIG. 5, the uppermost pusher plate 14 has been pivoted inwardly through slot 34 in pusher body 12 and into the interior of mast 18 and tube 19 via slot 24 and 24', respectively, so that it rests upon the top of ground rod 32. It will be appreciated that slots 24, 24' and 34 are aligned with one another. A tube 19, which is hollow and sized and configured so as to fit within mast 18, is connected to mast 18 by mast shims 25, 25' and 25" which are fixed to three of the interior walls of mast 18, the fourth wall having the slot 24 through which the pusher plates 14, 14' and 14" swing. Both tube 19 and mast shims 25, 25' and 25" run nearly the length of mast 18 so as to ensure that rod 32 will remain in registry with pusher plates 14, 14' and 14". Moreover, shims 25, 25' and 25" and tube 19, ensure that the rod which is being pressed into the earth does not warp or deform, as the tube 19 conforms closely to the rod which has been selected. Mast 18 may be constructed with appropriately sized tubes 19 which can accommodate the specific dimensions required by the particular utility company. It will be appreciated that the mast 18 with tube 19 may be constructed to accept variable diameters of ground rods, ranging in size from about 0.375 to about 1.000 inch.

Figure 6:
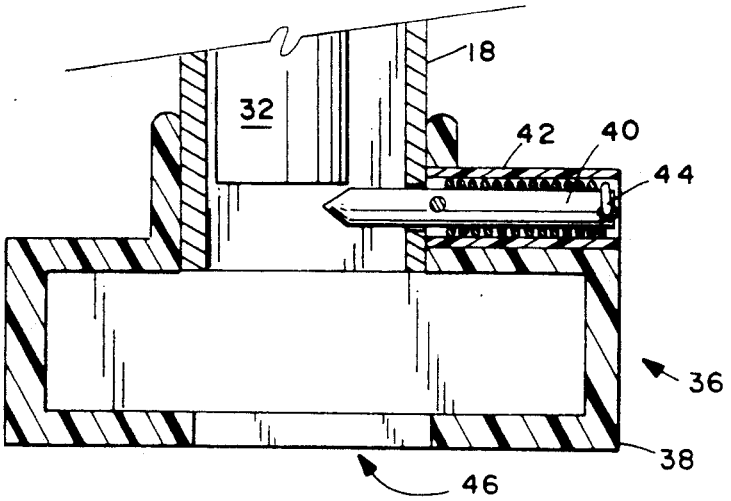
FIG. 6 is a cross sectional view illustrating the support foot containing a safety catch.

FIG. 6 illustrates a support foot 36 which contains a safety catch to keep the rod 32 from falling out of ground rod insertion device 10 when it is lifted or swung over the target area. Support foot 36 comprises a housing 38, sized so as to fit on the lower end of mast 18 and contains a pin 40; spring 42 and ring 44. Housing 38 is provided with a surface entry port 46 through which ground rod 32 will pass (a rod may also be inserted into tool 10 through port 46). Spring 42 biases pin 40 part way into the interior of mast 18 so that rod 32 is just caught by the end of pin 40 and is prevented from falling out. In a preferred embodiment, pin 40 may have a tapered or pointed end. Once the ground rod insertion tool 10 has been positioned for use, a down stroke from a prime mover, pushes rod 32 against the end of pin 40 so that pin 40 is then urged outwardly away from rod 32 thereby allowing rod 32 to be pressed into the ground. Moreover, as pin 40 is resiliently biased by spring 42 into contact with the rod, the pin 40 further serves to aid in guiding rod 32 after the it has been pushed out of the way.

Referring now to FIG. 7, a coupling tool 48 may be provided so as to automatically align ground rod insertion tool 10 with that of a previously driven rod 32 thereby enabling two or more ground rods 32', to be connected together. A first end 50 of coupling tool 48 fits over the end of pushing tool 10 on support foot 36 while the second end 52 is positioned over the inserted rod 32. It will be appreciated that coupling tool 48 is hollow to allow rods to pass through while being pushed or pressed into the earth. Coupling tool 48 may also contain a female connector 54, or alternatively, the rods 32 and 32' may be threadably connected together. The coupling tool 48 allows utility companies to insert varying lengths and/or widths of ground rods into the earth so as to obtain the optimum grounding depth required for a particular project. It is appreciated, that coupling tool 48 and female connector 54 (if present) may be configured to accept a variety of geometrically shaped ground rods, e.g. round, square, triangular, hexagonal, pentagonal, etc. as well as ground rods of varying diameters ranging from about 0.375 to about 1.000 inch.

In use, a ground rod 32 is selected and placed within tube 19 which is positioned within mast 18. (The ground rod may be inserted either through aperture 30 of top plate 26 or through surface entry port 46 of the support foot 36.) Once inserted, support foot 36 containing a safety catch, prevents the ground rod 32 from falling out onto utility workers or equipment while the tool is moved to the target area.

A small hole is now dug at the spot where the rod 32 will be inserted. The tool 10, containing ground rod 32, is positioned over the hole and then connected via pusher block 16, to a source which will provide mechanical energy to drive the rod into the surface, i.e. a prime mover. Once connected, pusher body 12 is at the top of mast 18, adjacent the prime mover and ready for the first downstroke.

The first pusher plate 14 is pivoted inwardly, about hinge pin 20, supported by mounting bars 22 and 22', through an appropriately sized slot 34 in pusher body 12 and through slots 24 and 24' of the mast 18 and tube 19, respectively, so as to rest upon the top of ground rod 32. The second and third pusher plates 14' and 14", respectively, continue to hang freely along side of pusher body 12 and do not interfere with mast 18 or ground rod 32. A down stroke, from the mechanical source, is applied to the rod insertion tool 10, pressing the pusher body 12 downward so that the first pusher plate 14, resting on the top of ground rod 32, pushes or presses the ground rod 32 into the surface a first distance. It will be appreciated that now pusher body 12 with first pusher plate 14 (still on the top of ground rod 32) has slid down the mast 18 a distance substantially equal to that of the first down stroke. The pusher body 12 is now retracted to the top of mast 18 whereby the top of ground rod 32 is adjacent to the second pusher plate 14'. The second pusher plate 14' is then pivoted inwardly through slots 34, 24 and 24', respectively, so as to rest on the top of ground rod 32. A second downward stroke is applied to drive ground rod 32 through pusher body 12 and second pusher plate 14' into the earth a second and additional distance. It will be appreciated that the pusher plates remain within mast 18 after use and do not interfere with the application of the second and subsequent downstrokes to the tool 10, as the force is applied only through the pusher plate which is presently resting on the rod 32. The pusher body 12 is once again retracted to the top of mast 18 and the third pusher plate 14'' is pivoted inwardly through slots 34, 24 and 24', respectively, so as to rest upon the top of ground rod 32. A third and final down stroke is applied to ground rod 32 through pusher body 12 and third pusher plate 14'' so as to push or press the ground rod 32 a third and final distance. In a preferred embodiment rod 32 may be entirely contained within tool 10. It will be appreciated that more than three pusher plates may be mounted on the pusher body so as to enable the user to press or push much longer rods.

It is understood that the spacing between the first, second and third pusher plates, 14, 14' and 14'', respectively, is substantially equivalent to the distance traveled during a single down stroke. Accordingly, for each the distance ground rod 32 is driven into the ground, the pusher body 12 must be retracted a substantially equal and opposite distance prior to the next pressing step.

After inserting a first rod, the utility company takes an ohm reading and if an unacceptable reading is obtained, the utility company may need to insert an additional rod into the earth. In order to drive additional rods into the earth a coupling tool 48 (FIG. 7) is connected to the bottom of the tool 10 at support foot 36. It will be appreciated that the rod 32 which has been pressed into the ground protrudes from the surface to allow wires to be connected to the rod. The coupling tool 48 is placed over the top of the rod and serves to automatically align pusher tool 10 over the previously inserted ground rod 32 so that a second ground rod 32' may be connected to a first ground rod 32 (the rods may be threably fastened to one another or alternatively, a female connected 54 may be used to connect the rods together). It will be appreciated that the coupling tool 48 may be sized and configured so as to readily accept any particular cross section of which a ground rod may be formed. Furthermore, coupling tool 48 and female connector 54 (if present) may be sized so as to accept ground rods having diameters in the range of about 0.375 to about 1.000 inch.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of inserting a rod into the earth using a tool having a hollow pusher body, a hollow elongated mast slidably received within said pusher body and provided with an elongated slot extended axially along said mast and a plurality of pivotally mounted pusher plates spaced along said pusher body, comprising the steps of:

(i) loading an elongated rod into said mast;

(ii) pivoting a first pusher plate through said slot of said mast to enable engagement of the pusher plate and an end of the rod;

(iii) applying a downstroke from a prime mover to said pusher body enabling said first pusher plate to push the rod into the earth a first distance;

(iv) retracting said pusher body so that the end of the rod is adjacent a second pusher plate;

(v) pivoting said second pusher plate through said slot in said mast to enable engagement of said second pusher plate and the end of the rod;

(vi) applying a second downward stroke from the prime mover to said pusher body enabling said second pusher plate to push the rod into the earth a second distance;

(vii) retracting said pusher body so that the end of the rod is adjacent a third pusher plate;

(viii) pivoting said third pusher plate through said slot in said mast to enable engagement of said third pusher plate and the end of the rod; and (ix) applying a downstroke from the prime mover to said pusher body enabling said third pusher plate to push the rod into the earth a third and final distance.

2. The method according to claim 1 including the step of retracting said pusher body a distance substantially equal to and in a direction opposite to that of a single downstroke of the prime mover.

3. A tool for pushing a rod into the earth, said tool comprising:

pusher body;

an elongated, slotted hollow mast positioned within said pusher body and sized and configured so that said pusher body may slide along said mast, said mast being adapted to receive the rod to be pushed into the earth;

at least one pusher plate connected with said pusher body;

said pusher plate being pivotable inwardly of said elongated, slotted mast to engage the rod so that a downwardly directed force applied to said pusher body causes said pusher plate to press the rod into the earth.

4. The tool according to claim 3 wherein said pusher body is elongated and includes three pusher plates spaced along said elongated pusher body.

5. The tool according to claim 4 wherein the spacing between adjacent pusher plates is substantially equal.

6. The tool according to claim 3 and including a prime mover adapted for connection to said pusher body.

7. A tool according to claim 3 wherein said mast is provided with a safety catch for engaging the rod and preventing it from falling out of said tool while said tool is being moved.

8. A tool according to claim 7 wherein said safety catch is housed within a support foot adjacent the lower end of said mast.

9. A tool according to claim 7 wherein said safety catch comprises a spring and pin.

10. A tool according to claim 3 wherein said mast is sized to accept a rod having a diameter in the range from about 0.375" to about 1.000".

11. A tool according to claim 3 wherein said elongated, slotted mast further comprises a top plate to provide a step between said pusher body and said mast.

12. A tool according claim 11 wherein said top plate is provided with an aperture offset from center.

13. A tool according to claim 3 including a coupling tool having a lower open end portion for receiving the upper end of a rod and an upper end portion for connection to said mast so that plural rods may be connected together and pressed into the earth.

14. A tool according to claim 13 wherein said coupling tool has a length for automatically aligning the tool over the upper end of a previously inserted rod so that an additional rod may be pressed into the ground.

15. A tool according to claim 13 wherein said coupling tool includes a female connector for connecting its upper end to said mast.

16. A tool according to claim 13 wherein said coupling tool is sized to accept a rod having a diameter in the range of about 0.375" to about 1.000" inch.

17. A tool according to claim 3 wherein said mast includes a tube for stabilizing the rod.

18. A tool according to claim 17 including means within said mast for locating said tube in the mast.

19. A tool according to claim 3 wherein said pusher body is elongated and includes a pair of pusher plates spaced one from the other along said pusher body, said mast having an elongated slot extending substantially at least the distance between said pair of pusher plates, each of said pusher plates being pivotable inwardly of said mast and through said elongated slot to engage an end of the rod so that downwardly directed forces applied to the pusher body cause said plate to press the rod into the earth.

* * * * *